US008646142B2

(12) United States Patent
Ferrara et al.

(10) Patent No.: US 8,646,142 B2
(45) Date of Patent: Feb. 11, 2014

(54) GOT YOUR BACK APPLICATOR SYSTEMS

(76) Inventors: Frank Ferrara, Rolling Hills Estate, CA (US); Lyn Ferrara, Rolling Hills Estate, CA (US)

( * ) Notice: Subject to any disclaimer, the term of this patent is extended or adjusted under 35 U.S.C. 154(b) by 35 days.

(21) Appl. No.: 13/343,143

(22) Filed: Jan. 4, 2012

(65) Prior Publication Data

US 2012/0177430 A1 Jul. 12, 2012

Related U.S. Application Data

(60) Provisional application No. 61/431,144, filed on Jan. 10, 2011.

(51) Int. Cl.
*A45D 34/04* (2006.01)
*A47K 7/02* (2006.01)

(52) U.S. Cl.
USPC ..... 15/104.001; 15/144.2; 15/144.4; 15/210.1; 15/244.1; 15/244.2; 132/320; 601/137; D28/7

(58) Field of Classification Search
USPC ..... 15/104.001, 104.94, 144.1–144.4, 15/209.1, 210.1, 244.1, 244.2; 132/320; 401/6; 604/1; D28/7; 601/137, 138
See application file for complete search history.

(56) References Cited

U.S. PATENT DOCUMENTS

| | | | | | |
|---|---|---|---|---|---|
| 1,973,768 | A | * | 9/1934 | Knapp | 601/107 |
| 3,103,682 | A | * | 9/1963 | Markle | 15/244.1 |
| 4,299,005 | A | * | 11/1981 | Brown | 15/244.2 |
| 4,483,356 | A | * | 11/1984 | Kales | 132/320 |
| D342,342 | S | * | 12/1993 | Maglione | D28/7 |
| 5,360,111 | A | | 11/1994 | Arispe | |
| 5,568,669 | A | * | 10/1996 | Godown | 15/143.1 |
| 5,671,497 | A | * | 9/1997 | Abdo | 15/144.1 |
| 5,823,206 | A | * | 10/1998 | Mapleback | 132/320 |
| D425,661 | S | * | 5/2000 | Fenenga | D28/7 |
| 6,415,470 | B1 | | 7/2002 | Ramrattan | |
| 6,438,787 | B1 | * | 8/2002 | Young | 15/210.1 |
| 6,986,617 | B1 | | 1/2006 | Denker | |
| 8,015,653 | B2 | * | 9/2011 | Bargiel et al. | 15/144.2 |
| 2008/0307595 | A1 | * | 12/2008 | Zielinski | 15/144.4 |
| 2009/0106921 | A1 | * | 4/2009 | Davitt | 15/144.4 |

* cited by examiner

*Primary Examiner* — Mark Spisich

(57) ABSTRACT

A multi-fluid applicator utensil comprising a head assembly having a head section; a face surface; a back surface; and a receiver and a handle assembly having a shank and a gripper. The head assembly is pivotally mounted on the handle assembly with the shank received by the receiver located in the head section. The head assembly comprises a socket. The handle assembly comprises a ball pivotable in the socket. The shank is telescopic providing an extended length of about twelve inches and a retracted length of about 8½ inches. The gripper provides a grippable surface by which a user-applier is able to manipulate the multi-fluid applicator utensil. The multi-fluid applicator utensil comprises injection-molded thermoplastic and is useable by the user-applier to surface-apply the oil, lotion and cream to the bodily skin surface in hard-to-reach locations.

16 Claims, 5 Drawing Sheets

GOT YOUR BACK APPLICATOR SYSTEMS

CROSS-REFERENCE TO RELATED APPLICATION

The present application is related to and claims priority from prior provisional application Ser. No. 61/431,144, filed Jan. 10, 2011 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of applicators and more specifically relates to a multi-fluid applicator suitable for use with lotions, creams, and oils.

2. Description of the Related Art

Many individuals manually apply lotions, creams and oils to themselves or to others to provide skin protection and rejuvenation. Lotions, creams and oils are typically applied to skin surfaces with bare hands, a clean cloth, cotton wool or gauze. Many lotions, especially hand creams and face cream are formulated not as a medicine delivery system, but simply to smooth, re-hydrate, and soften the skin they are applied upon. Most lotions are oil-in-water emulsions using a substance such as cetearyl alcohol to keep the emulsion together, but water-in-oil lotions may also be formulated. The key components of a skin care lotion, cream or gel emulsion are the aqueous and oily phases, an emulgent to prevent separation of these two phases, and, if used, the drug substance or substances. A wide variety of other ingredients such as fragrances, glycerol, petroleum jelly, dyes, preservatives, proteins and stabilizing agents are commonly added to lotions. Creams may also be used and are typically thicker in consistency than lotions.

Oils are typically lower in viscosity than lotions and creams. Oils such as suntan oil may be used to protect skin from the harmful effects of the sun. Often times these lotions, creams and oils may be difficult to apply to areas on the human body such as the middle of the back since an individual's arms don't readily contort to reach such difficult to reach surfaces. As a result the individual may not have a complete application leading to uneven tans and/or sunburns. Sunburns may lead to cancer over a period of time. Certain individuals may seek out another person to apply the oil, lotion or cream, but this may prove to be inconvenient or provide an awkward or uncomfortable situation. It is desirable that an efficient means for self-applying solutions over the entire body surface be provided.

Various attempts have been made to solve problems found in applicator art. Among these are found in: U.S. Pat. No. 5,360,111 to Arispe; U.S. Pat. No. 6,415,470 to Ramrattan; and U.S. Pat. No. 6,986,617 to Denker. This prior art is representative of applicators. None of the above inventions and patents, taken either singly or in combination, is seen to describe the invention as claimed.

Ideally, an applicator should be user-friendly and, yet would operate reliably and be manufactured at a modest expense. Thus, a need exists for a reliable multi-fluid applicator system to apply lotions, oils and creams to hard-to-reach locations on the human body and to avoid the above-mentioned problems.

BRIEF SUMMARY OF THE INVENTION

In view of the foregoing disadvantages inherent in the known applicator art, the present invention provides a novel multi-fluid applicator system. The general purpose of the present invention, which will be described subsequently in greater detail is to provide application means for lotions, oils and creams to difficult to reach areas of the human body.

A multi-fluid applicator utensil is disclosed herein, in a preferred embodiment comprising a head assembly and a handle assembly. The head assembly includes a head section; a face surface; a back surface; and a receiver. The handle assembly includes a shank and a gripper. The head assembly is mounted on the handle assembly with the shank received by the receiver located in the head section. The head assembly preferably comprises a socket; the handle assembly comprising a ball pivotable in the socket on the head assembly. Thus, the head assembly is able to be pivotably mounted on the handle assembly.

The head section comprises a circular profile and is manufactured of non-absorbent plastic in preferred embodiments. The head section is about 2 inches in diameter and about ½ inch thick. The extremities of the head section are defined by the face surface and the back surface; the back surface supporting the face surface. The face surface is substantially planar and is useful to surface-apply oil, lotion and cream to a bodily skin surface.

The shank is received by the gripper in preferred embodiments; the gripper providing gripping means for the user-applier. The shank may also be telescopic providing an extended length of about twelve inches and a retracted length of about 8½ inches. The gripper provides a grippable surface by which a user-applier is able to manipulate the multi-fluid applicator utensil. The multi-fluid applicator utensil comprises injection-molded thermoplastic and is useable by the user-applier to surface-apply the oil, lotion and cream to the bodily skin surface in hard-to-reach locations.

A kit is also described herein including a plurality of multi-fluid applicator utensils; in various designs and color schemes; various fluids such as creams, lotion, and oils; and a set of user instructions.

A method of using a multi-fluid applicator utensil system is disclosed herein preferably comprising the steps of: dispensing an amount of fluid onto a face surface of a head section located on a head assembly of the multi-fluid applicator utensil; manipulating a handle assembly pivotably attached to the head assembly to apply the fluid on a bodily surface; and telescoping the handle assembly in relation to the head assembly to reach a hard-to-reach location on the bodily surface.

The present invention holds significant improvements and serves as a multi-fluid applicator system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, multi-fluid applicator utensil, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to an applicator device and more particularly to a multi-fluid applicator utensil as used to improve the application means for lotions, oils and creams to hard-to-reach locations on the human body.

Generally speaking, the present invention serves to assist users in preventing the harmful effects of the sun by enabling consumers to apply sunscreen lotions, oils and creams to hard-to-reach skin surface areas. The applicator is a compact, telescopic, tubular device manufactured from injection-molded thermoplastic in preferred embodiments. The applicator head is preferably oval (circular) measuring approximately 2-2¼ inches in width and about ½-¾ inches thick. The head attaches to the telescopic pole preferably via a swivel mechanism and may be fabricated in a soft and non-absorbent material to hold and spread the lotion or oil onto the body. The device handle may be about ½ to ¾ inches in circumference and in its closed compact state would measure approximately 8-8½ inches. When fully extended the telescopic handle preferably measures between 11½ and 12 inches, suitable to comfortably reach across the individuals back. The present applicator may be produced in a wide array of colors.

The applicator provides consumers with a practical solution to apply their favorite sunblock lotions, creams and oils onto their backs potentially preventing those hard-to-reach areas from developing skin cancer, as previously mentioned. The applicator is not limited to lotions and oils, but may be used for application of oils and other solutions such as medicated ointments for example. Individuals that may benefit from the sunblock applicator include those traveling alone, those without someone readily available to assist you, or even those who aren't comfortable being touched by another person.

Figure 1:
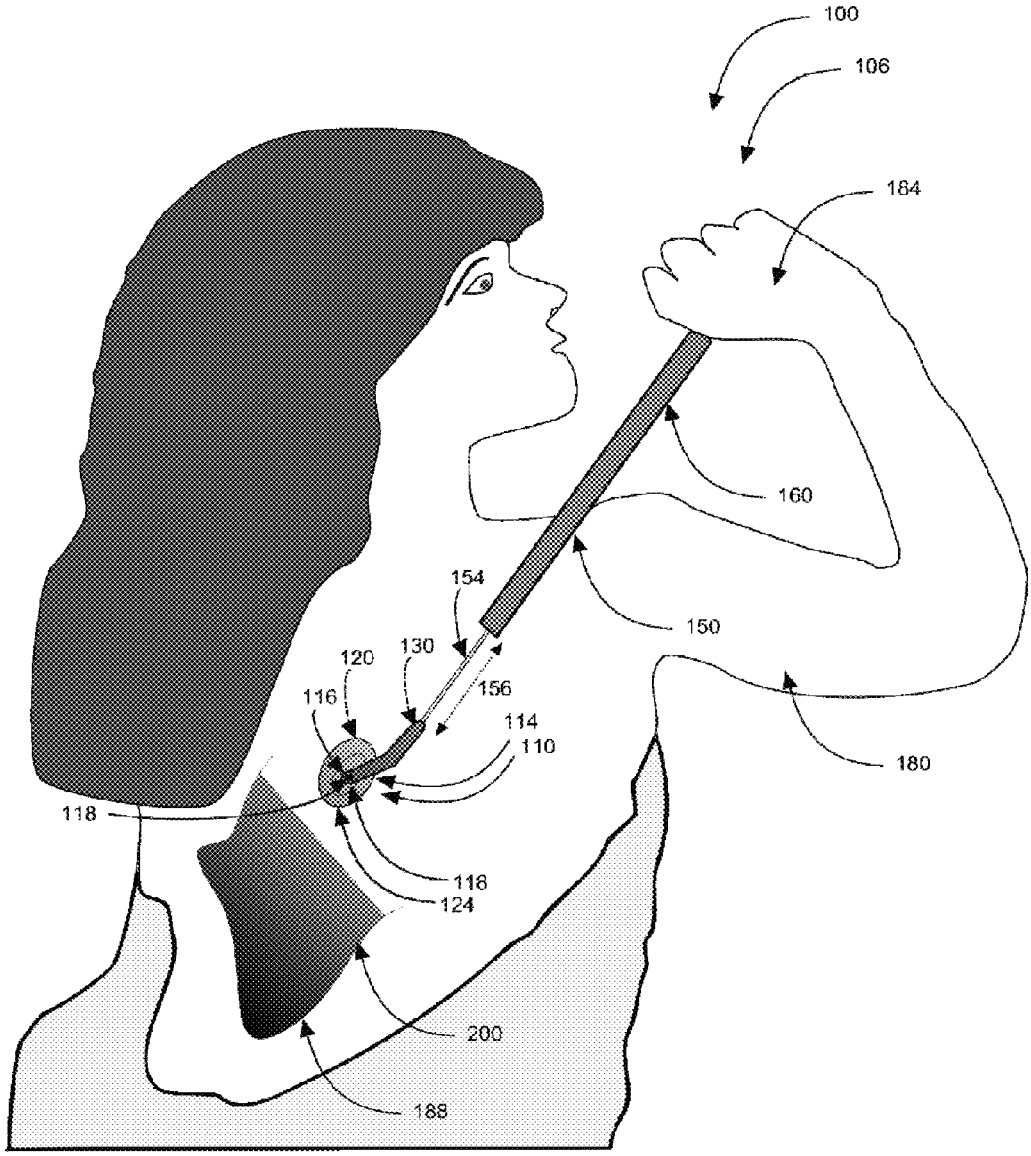
FIG. 1 shows a perspective view illustrating a multi-fluid applicator utensil in an in-use condition according to an embodiment of the present invention.

Referring to the drawings by numerals of reference there is shown in FIG. 1, a perspective view illustrating multi-fluid applicator utensil 100 in 'in-use' condition 106 according to an embodiment of the present invention.

Multi-fluid applicator utensil 100 preferably comprises head assembly 110 and a handle assembly 150. Head assembly 110 preferably includes head section 114; face surface 120; back surface 124; and receiver 130. Handle assembly 150 preferably includes shank 154; and gripper 160. Head assembly 110 is preferably mounted on handle assembly 150 with shank 154 received by receiver 130 located in head section 114. Extremities of head section 114 are defined by face surface 120 and back surface 124. Additionally face surface 120 is useful to surface-apply at least one fluid to a bodily skin surface 188.

Shank 154 is received by gripper 160. Gripper 160 provides a grippable surface by which user-applier 180 is able to manipulate multi-fluid applicator utensil 100. Multi-fluid applicator utensil 100 is useable by user-applier 180 to surface-apply the at least one fluid to a bodily skin surface 188 in hard-to-reach locations. Shank 154 is telescopic 156 (as indicated by directional arrows and again in FIG. 4) providing an extended length of about twelve inches and a retracted length of about 8½ inches.

Head assembly 110 is preferably pivotably mounted on handle assembly 150. Head assembly 110 may comprises socket 116 and ball 118 (assembly) providing rotational means. Ball 118 of handle assembly 150 is preferably pivotable in socket 116. Upon reading this specification, it should be appreciated that, under appropriate circumstances, considering such issues as user preferences, design preference, structural requirements, marketing preferences, cost, available materials, technological advances, etc., other rotational arrangements such as, for example, flexible, rotational/pivotable, non-pivotable means, etc., may be sufficient. Head assembly 110 may be either molded to arm extension or may be comprised of a ball 118 and socket 116.

Figure 2A:
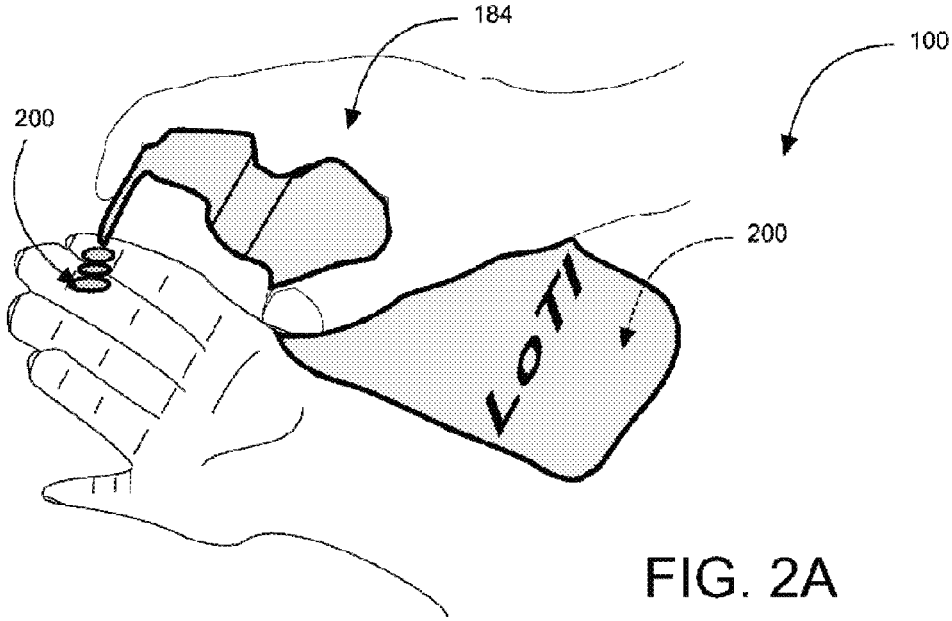
FIG. 2A is a perspective view illustrating a user-applier applying at least one fluid first to a hand to be surface-applied to a skin surface before using the multi-fluid applicator utensil to place lotion according to an embodiment of the present invention of FIG. 1.
Figure 2B:
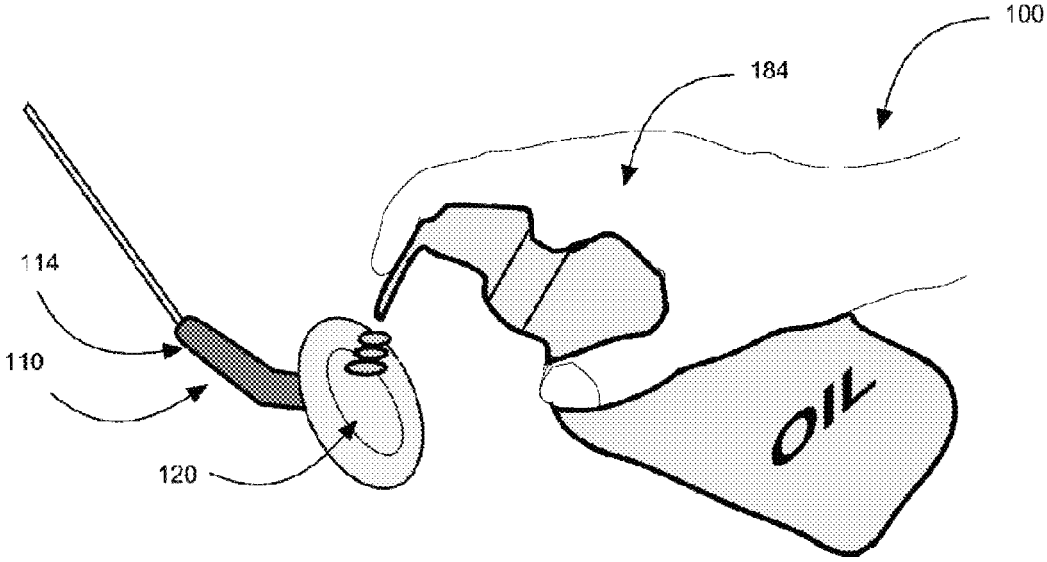
FIG. 2B is a perspective view illustrating a user-applier applying lotion to a face surface of the multi-fluid applicator utensil before surface-applying to a bodily surface according to an embodiment of the present invention of FIG. 1.

Referring now to FIG. 2A, a perspective view illustrating user-applier 180 applying at least one fluid first to hand 184 to be surface-applied to a skin surface before using the multi-fluid applicator utensil 100 to place lotion 200 according to an embodiment of the present invention of FIG. 1. FIG. 2B is a perspective view illustrating user-applier 180 applying lotion 200 to a face surface 120 of multi-fluid applicator utensil 100 before surface-applying to bodily skin surface 188 according to an embodiment of the present invention of FIG. 1.

Head section 114 comprises a circular profile in preferred embodiments but may comprise other shapes in alternate embodiments. Face surface 120 may be convex, concave or planar (substantially). Face surface 120 of head section 114 is usable to apply at least one fluid, with the at least one fluid comprising oil, lotion 200 (shown) and/or cream. In this way the present invention may be used to apply and distribute liquids (fluids) of varying viscosities to bodily skin surface 188.

Figure 3:
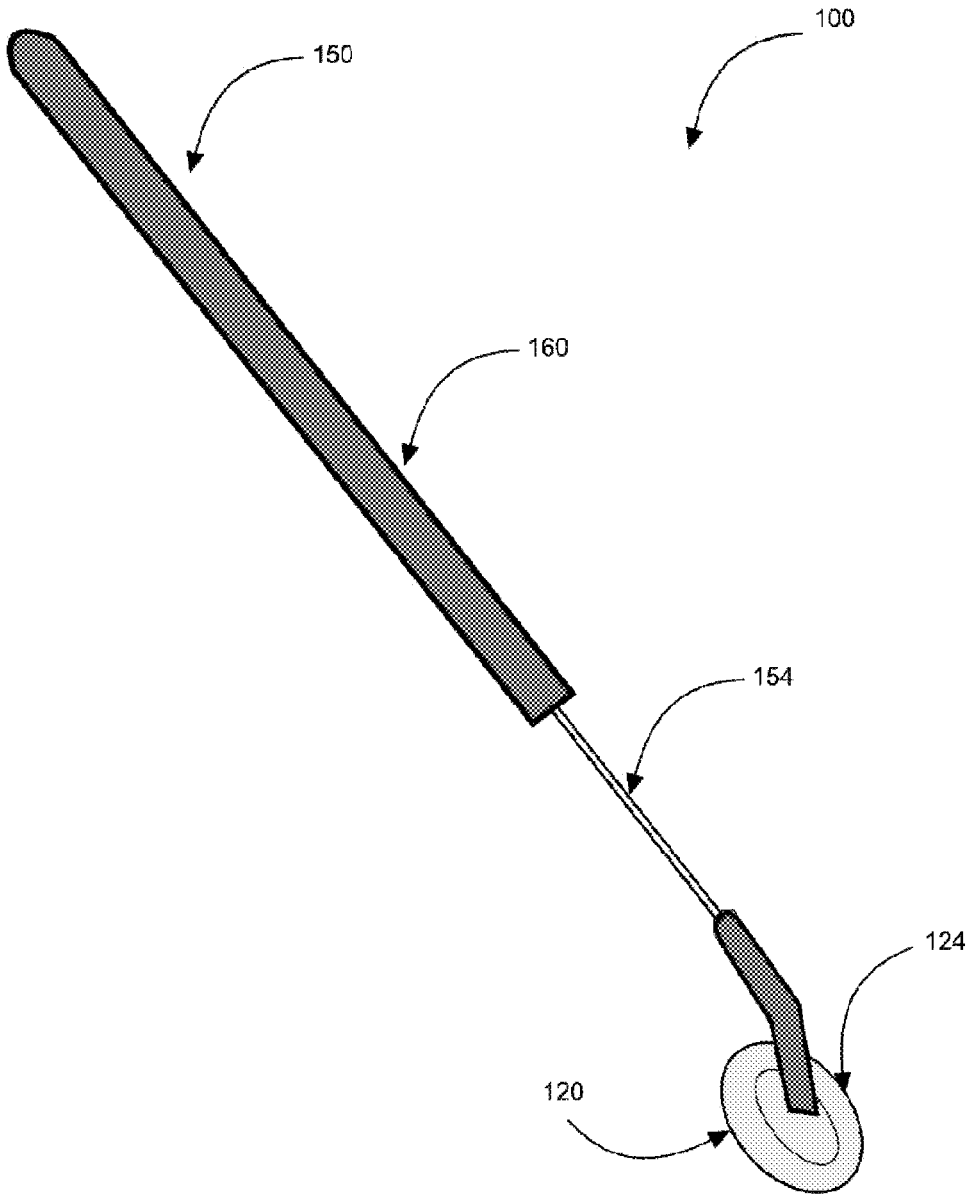
FIG. 3 is a perspective view illustrating a back of the multi-fluid applicator utensil according to an embodiment of the present invention of FIG. 1.

Referring now to FIG. 3, a perspective view illustrating a back of multi-fluid applicator utensil 100 according to an embodiment of the present invention of FIG. 1.

Head section 114 is about 2 inches in diameter in preferred embodiments. Head section 114 is about ½ inch thick. Head section 114 preferably comprises non-absorbent plastic. In certain embodiments multi-fluid applicator utensil 100 comprises injection-molded thermoplastic. Upon reading this specification, it should be appreciated that, under appropriate circumstances, considering such issues as user preferences, design preference, structural requirements, marketing preferences, cost, available materials, technological advances, etc., other material arrangements such as, for example, re-enforced durable rubber; other molded plastics, etc., may be sufficient.

In an alternate embodiment head section 114 may be removeably-attached. When head section 114 is removeably-attached, user-applier 180 may exchange head section 114 when user-applier 180 sees fit such as when head section 114 becomes worn down or unsanitary for example.

Figure 4:
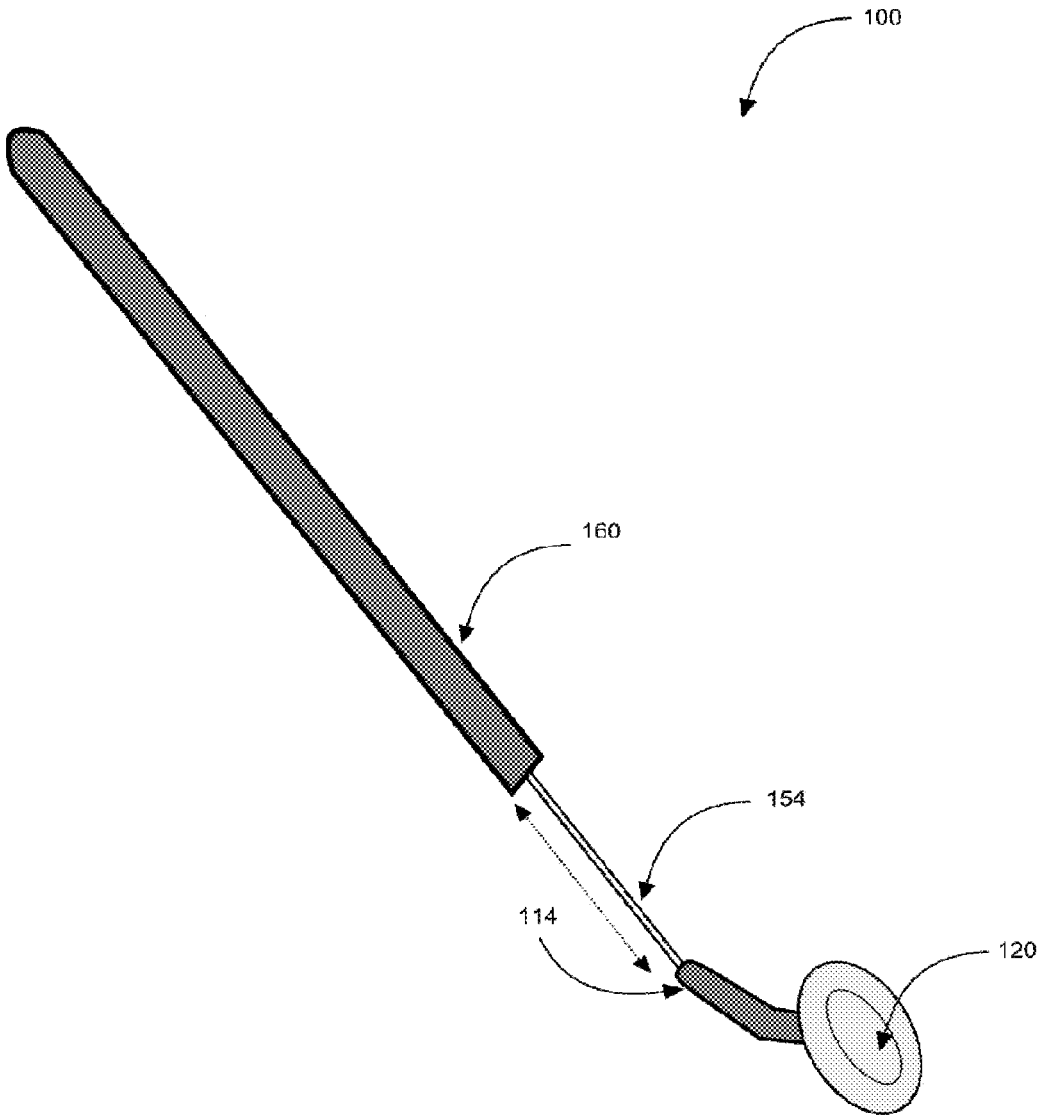
FIG. 4 is a perspective view illustrating a front of the multi-fluid applicator utensil (directional arrow indicating telescoping means) according to an embodiment of the present invention of FIG. 1.

Referring now to FIG. 4, a perspective view illustrating a front of multi-fluid applicator utensil 100 (directional arrow indicating telescoping means) according to an embodiment of the present invention of FIG. 1.

Shank 154 of multi-fluid applicator utensil 100 is preferably telescopic 156 providing an extended length of about twelve inches and a retracted length of about 8½ inches as also previously shown in FIG. 1. Multi-fluid applicator utensil 100 may be produced in a variety of fashionable colors, men, women, and children can color coordinate the applicator with their swimsuit attire in certain kits. In addition, multi-fluid applicator utensil 100 is easy to use, provides a sanitary application means in which user-applier 180 is able to slip inside a hikers backpack, a woman's purse, and/or a child's tote. Multi-fluid applicator utensil 100 may also be attached to sunscreen products as an aftermarket accessory.

Multi-fluid applicator utensil 100 may be sold as kit 440 comprising the following parts: multi-fluid applicator utensil(s) 100; various fluids such as creams, lotion 200, and oils; and a set of user instructions. Multi-fluid applicator utensil 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
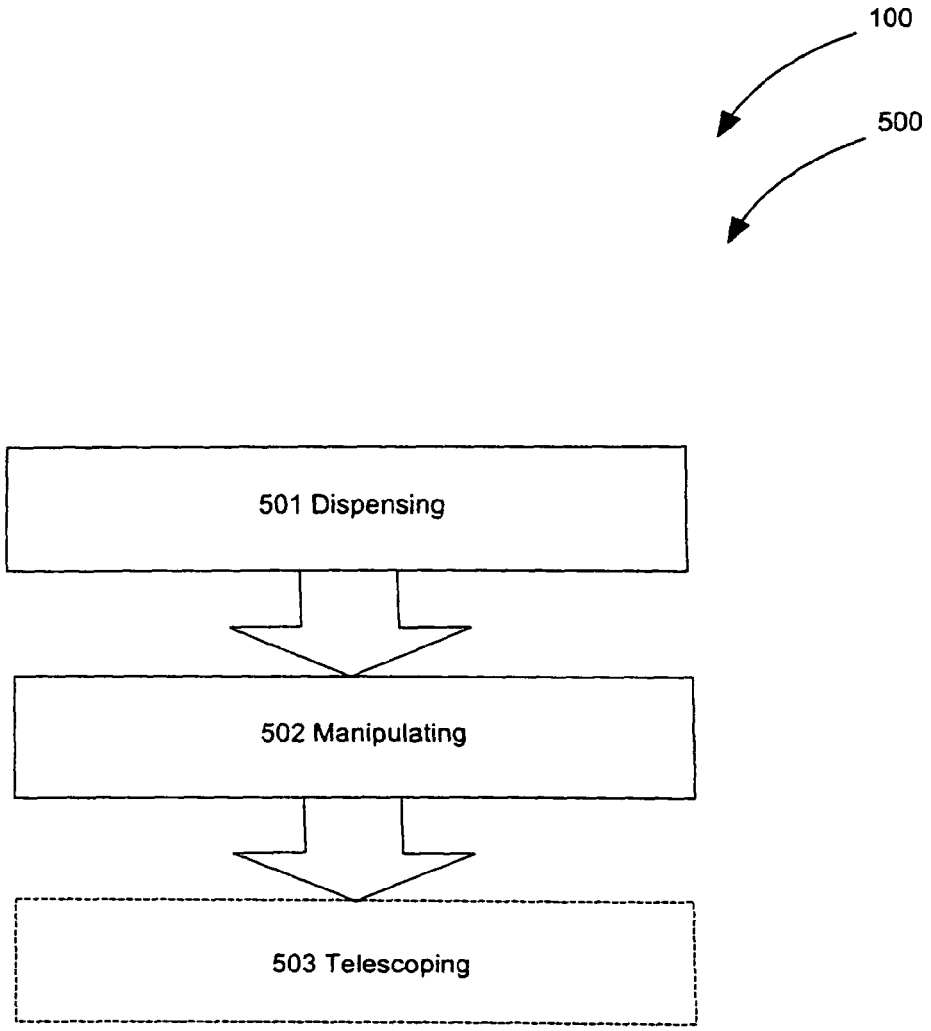
FIG. 5 is a flowchart illustrating a method of using the multi-fluid applicator utensil according to an embodiment of the present invention of FIGS. 1-4.

Referring now to FIG. 5, a flowchart illustrating a method of using multi-fluid applicator utensil 100 according to an embodiment of the present invention of FIGS. 1-4.

A method of using (enabling method of use 500) multi-fluid applicator utensil 100 preferably comprises the steps of: step one 501 dispensing an amount of fluid onto face surface 120 of head section 114 located on head assembly 110 of multi-fluid applicator utensil 100; step two 502 manipulating handle assembly 150 (pivotably attached to head assembly 110) to apply the fluid on a bodily surface; and step three 503 telescoping handle assembly 150 in relation to head assembly 110 to reach a hard-to-reach location on the bodily surface. The device may be telescoped inwardly for storage. User-applier 180 may leave multi-fluid applicator utensil 100 in its compact state to store and when ready for use, user-applier 180 may apply at least one fluid such as sunblock or oil face surface 120, then extend the telescopic handle assembly 150 to the desired length and easily and efficiently apply the product to their hard-to-reach areas. Clean up for multi-fluid applicator utensil 100 is a user-friendly process as well. User-applier 180 condenses handle assembly 150 and wipes off any excess product with hand 184 and rubs the excess fluid onto a desired body portion. Face surface 120 of multi-fluid applicator utensil 100 is then ready to be used at a future use.

It should be noted that step 503 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A multi-fluid applicator utensil comprising:

a head assembly having:

a head section comprised of a non-absorbent plastic material having a face surface and a back surface, said head section having either an oval or circular profile; and a receiver including a bend in a middle portion thereof and defining first and second substantially straight receiver portions on opposed sides of the bend, an end of the first receiver portion being secured to a central portion of the back surface of the head section;

a handle assembly having:

an elongate telescopic shank extendable from a retracted length to an extended length;

an elongate gripper; and wherein one end of the shank is received in an end of the second receiver portion and an opposite end of the shank is received in said gripper, said gripper and shank being substantially coaxial with the second receiver portion;

wherein the face surface of the of the plastic head section is adapted to directly receive at least one fluid thereon for applying said fluid to a bodily skin surface;

wherein said gripper provides a grippable surface by which a user-applier is able to manipulate said utensil; and wherein said utensil is useable by said user-applier to surface-apply said fluid to said bodily skin surface in hard-to-reach locations.

2. The multi-fluid applicator utensil of claim 1 wherein said shank has an extended length of about twelve inches and a retracted length of about 8½ inches.

3. The multi-fluid applicator utensil of claim 1 wherein said head section comprises a circular profile.

4. The multi-fluid applicator utensil of claim 3 wherein said face surface is convex.

5. The multi-fluid applicator utensil of claim 3 wherein said face surface is concave.

6. The multi-fluid applicator utensil of claim 3 wherein said face surface is planar.

7. The multi-fluid applicator utensil of claim 6 wherein said head section is about 2 inches in diameter.

8. The multi-fluid applicator utensil of claim 7 wherein said head section is about ½ inch thick.

9. The multi-fluid applicator utensil of claim 8 wherein said first receiver portion is pivotably mounted to the head section.

10. The multi-fluid applicator utensil of claim 9 wherein said head section comprises a socket.

11. The multi-fluid applicator utensil of claim 10 wherein said first receiver portion comprises a ball pivotable in said socket.

12. The multi-fluid applicator utensil of claim 1 wherein said face surface of said head section is usable to apply at least one said at least one fluid, said at least one fluid comprising cream.

13. The multi-fluid applicator utensil of claim 12 wherein said cream comprises medication.

14. The multi-fluid applicator utensil of claim 1 wherein said face surface of said head section is usable to apply at least one said at least one fluid, said at least one fluid comprising oil.

15. The multi-fluid applicator utensil of claim 1 wherein said face surface of said head section is usable to apply at least one said at least one fluid, said at least one fluid comprising lotion.

16. The multi-fluid applicator utensil of claim 1 wherein said plastic of said head section comprises injection-molded thermoplastic.

* * * * *